US006638081B2

(12) United States Patent
Korsunsky et al.

(10) Patent No.: US 6,638,081 B2
(45) Date of Patent: Oct. 28, 2003

(54) ELECTRICAL CONNECTOR

(75) Inventors: Iosif R. Korsunsky, Harrisburg, PA (US); Robert W. Brown, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/104,832

(22) Filed: Mar. 22, 2002

(65) Prior Publication Data

US 2003/0181079 A1 Sep. 25, 2003

(51) Int. Cl.[7] ..... H01R 12/20
(52) U.S. Cl. ..... 439/79; 439/108
(58) Field of Search ..... 439/79, 108, 101, 439/701, 247

(56) References Cited

U.S. PATENT DOCUMENTS 5,292,265 A * 3/1994 Chen et al. ..... 439/876
5,320,541 A * 6/1994 Korsunsky et al. ..... 439/79
5,813,871 A * 9/1998 Grabbe et al. ..... 439/108
5,823,799 A * 10/1998 Tor et al. ..... 439/79
5,893,764 A * 4/1999 Long ..... 439/79
5,971,775 A * 10/1999 Tor et al. ..... 439/79
6,152,742 A * 11/2000 Cohen et al. ..... 439/60
6,179,629 B1 * 1/2001 Lai et al. ..... 439/79
6,231,355 B1 * 5/2001 Trammel et al. ..... 439/79
6,296,496 B1 * 10/2001 Trammel ..... 439/79

* cited by examiner

*Primary Examiner*—Gary Paumen
(74) *Attorney, Agent, or Firm*—Wei Te Chung

(57) ABSTRACT

An electrical connector (1, 1') straddle-mounted on an edge (20, 20') of a printed circuit board (2, 2') includes an insulative housing (10) having an elongated groove (11) for mating. A number of receiving channels (13) each used to receive a support subassembly (3, 3') is formed adjacently to and communicated with the mating groove (11). The support subassembly includes a base (30, 30') with signal terminals (5, 5') and a grounding member (4, 4') attached thereon. Every terminal includes an engaging end (51, 51') exposed to the mating groove (11) and a tail end (52, 52') extending out of the receiving channel (13). The grounding member includes a number of contacting legs (42, 42') extending therefrom. A notch (34, 34') with a thinned area is disposed on the base to define a separating portion (33, 33') from the base. The notch is used to facilitate relocating the separating portion relative to the base. The separating portion of the base can be positioned between the tail ends of the terminals and the contacting legs of the grounding member to electrically insulate them from each other while the shape of the tail ends and the contacting legs are changeable for being mounted on another desired printed circuit board with a different thickness. The separating portion can be moved for the assembling of every terminal and the grounding member when they need to put together to form the support subassembly for being inserted into the housing.

18 Claims, 8 Drawing Sheets

ELECTRICAL CONNECTOR

BACKGROUND OF THE INVENTION

1. Field of the Invention

The present invention is related to an electrical connector, especially to a straddle connector which is straddle-mounted on an edge of a printed circuit board wherein the terminals of the connector connect to pads disposed at either one or both sides of the printed circuit board.

2. Description of the Related Art

Printed circuit boards play an important role in the computer industry. Currently, most electrical or electronic functions are achieved on a motherboard, which is one kind of a printed circuit board which is installed inside of every computer. Many electronic components, such as a CPU, memory etc., and peripheral devices, like a CD ROM, a hard disk etc., must be connected to the motherboard before they work. However, the necessary connections take up a large amount of space, which complicates the layout of the motherboard and reduces the available space on the motherboard. Therefore, considering the corresponding location and size of some electronic components and the motherboard, some of the supporting connectors are straddle-mounted on the edge of a motherboard or a daughter board connected thereto to save space on the motherboard and to facilitate the installation of some larger peripheral devices. Two known contact arrangements for connectors to be straddle mounted on a printed circuit board can be considered for adoption. Chen et al. U.S. Pat. No. 5,292,265 and Long U.S. Pat. No. 5,893,764 both introduce connectors having two rows of contacts where contacts of one row are engaged on one side of the printed circuit board while contacts of the other row are engaged on the opposite side. A curved tail of every contact is disposed for engaging with a corresponding pad mounted on the printed circuit board due to the difference between the thickness of the printed circuit board and the distance between the two contact rows. These vulnerable contact tails without auxiliary guiding means or fixtures cause problems before the connector is straddle mounted on the printed circuit board. Tor et al. U.S. Pat. Nos. 5,823,799 and 5,971,775 show all the contacts are soldered onto only one side of the printed circuit board, no matter how many rows of contacts the connector has. This type of contact tail arrangement is more easily made and protected because it avoids unnecessary collision in the mounting process. But the space on the edge side of the printed circuit board is still limited, which results in the corresponding soldering pads on the printed circuit board being so close to each other that the soldering process is complicated. The above-mentioned two arrangements may be adopted at the same time when the number of contacts is increased, but the size of the connector is shortened, following one current design tendency. Therefore, high density connectors with multi rows of contacts have been introduced to meet the need of high speed transmission. Schmidgall et al., European Patent Application No. 01126552, shows a connector with three rows of contacts, which straddle mounts on a printed circuit board by soldering two rows of contacts on the same side of the printed circuit board. The row of contacts that is farther from the edge surface of the printed circuit board than the others needs longer and specially bent tails to be engaged with the printed circuit board. Dense soldering pads cause higher cost and more difficult soldering, and well designed guiding and fixing means may be needed to protect contact tails from colliding and damaging each other.

Furthermore, crosstalk is usually a concern in high density connectors, especially for high speed transmission. Grounding means is then added to surround and shield contacts from each other in order to get higher electrical performance. Cohen et al. U.S. Pat. No. 6,152,742 and Grabbe et al. U.S. Pat. Nos. 5,320,541 and 5,813,871 all introduce a straddle mount connector having a grounding plate disposed between two rows of contacts. The grounding plate has tails extending near tails of contacts and being soldered onto the same edge of the printed circuit board to establish electrical grounding paths. Obviously, there are many more tails, including both signal and grounding tails, than are needed to connect with the printed circuit board. Cost is high and it takes time to arrange these connector tails and soldering pads on the printed circuit board, and space on the printed circuit board is limited. And specialized parts, like nonstandard holes in the printed circuit board, as shown in the above patents, are always expensive and time consuming. In particular, tails of the grounding plate and tails of contacts cannot be spaced far enough away from each other due to the limited space. Shorting circuiting between contacts may result, because tails of the grounding plate may accidentally collide with the contact tails due to the strong straddle mount force required when mounting the connector to the printed circuit board, and the high density arrangement of the connector tails. To avoid such accidental collisions due to the use of so many long tails, an expensive insert molding method may be necessary to assemble the contacts and the grounding plate with the connector housing.

SUMMARY OF THE INVENTION

Therefore, an object of the present invention is to provide a straddle mount connector having an adjustable insulated separating portion to isolate terminal tail ends and legs of the grounding member from each other to reduce the potential of accidental collision while they are installed onto the printed circuit board.

Another object of the present invention is to provide a straddle mount connector having an adjustable insulated separating portion to properly isolate terminal tail ends from legs of the grounding member at all times, even though the connector may be installed onto at least two printed circuit boards each having a different board thickness from the other.

Another object of the present invention is to provide a straddle mount connector having an adjustable insulated separating portion to assemble terminals and the grounding member mechanically rather than using the expensive process of insert molding when tail ends of terminals and legs of the grounding member vary to be mounted on at least two different printed circuit boards.

To obtain the above objects, an electrical connector straddle-mounted on an edge of a printed circuit board includes an insulative housing having an elongated groove for mating. A plurality of receiving channels each used to receive a support subassembly is formed adjacently to and communicated with the mating groove. The support subassembly includes a plane-like base having a plurality of parallel arranged passageways formed on one surface of the base and a protrusion formed on the other. Pin-like signal terminals are inserted into the passageways respectively along the surface of the base and a plate-like grounding member is installed abutting against the other surface of the support subassembly to be fixed on the protrusion. A bar portion transversely protruding from the surface of the base having passageways, several holding portions formed in a hook shape on one edge side of the grounding member and the protrusion are all used to stop the insertion of the support subassembly when it is assembled into the housing. Every terminal includes an engaging end exposed to the mating groove once the terminal is inserted into the housing accompanying the support subassembly, and a tail end extending out of the receiving channel in a suspended status. And the grounding member includes a plurality of contacting legs extending away from the grounding member for a predetermined distance and being suspended similar to the tail end of every terminal.

Specifically, a hinge portion with a thinned area on the base and defines an elongate notch thereon. The hinge portion is a hinge area used to facilitate relocating the separating portion relative to the base. Therefore, the separating portion of the base can always be positioned between the tail ends of terminals and the contacting legs of the grounding member to electrically insulate them from each other though the shape of tail ends and contacting legs are changed to be mounted on another desired printed circuit board with a different thickness. And the separating portion can be moved for the ease of assembling every terminal and grounding member when they are put together to form the support subassembly being inserted into the housing.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
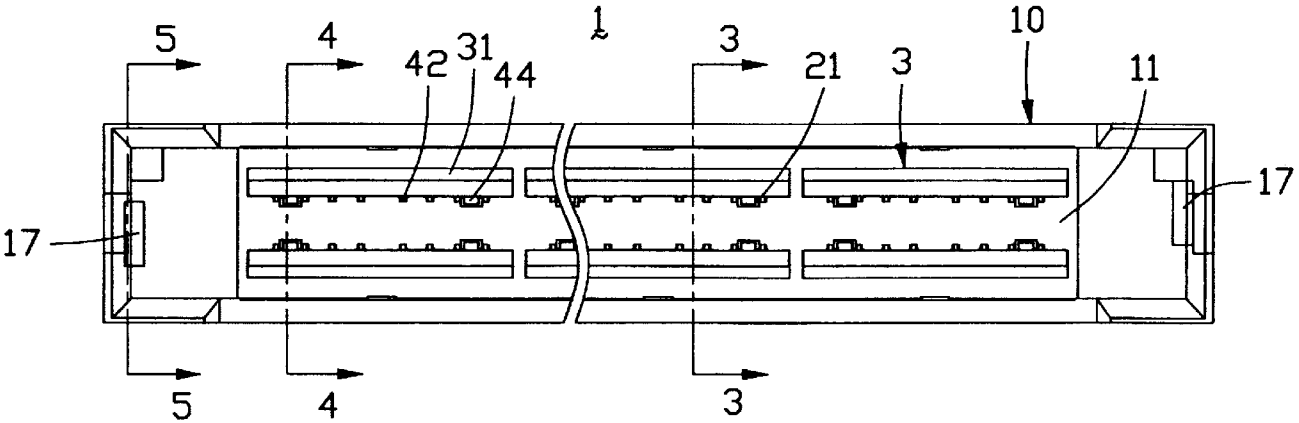
FIG. 1 is a mating side plan view of an electrical connector in accordance with the present invention.
Figure 2:
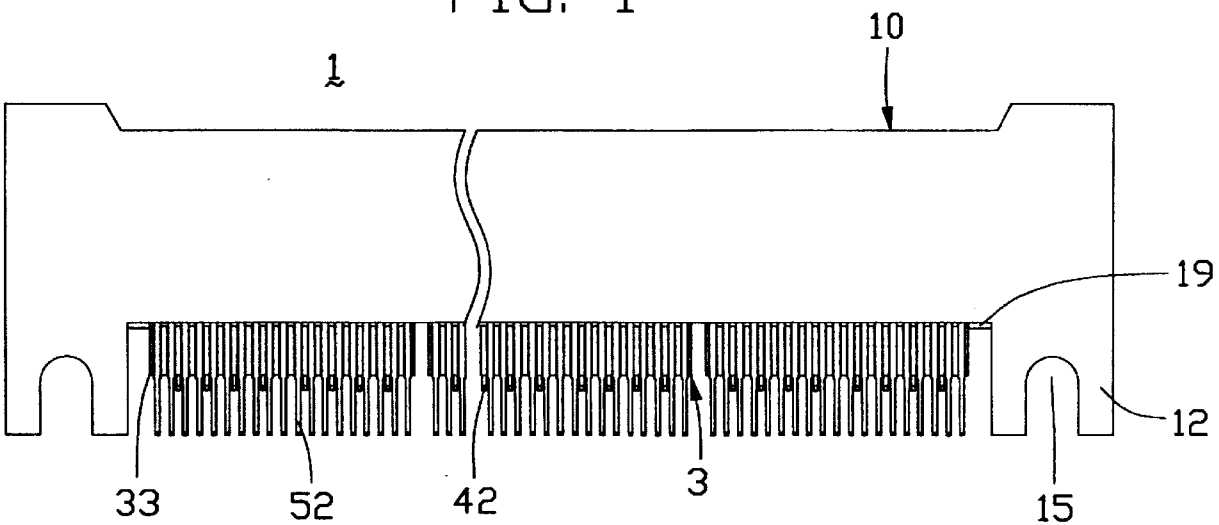
FIG. 2 is an elevation view of the electrical connector in accordance with the present invention.
Figure 3:
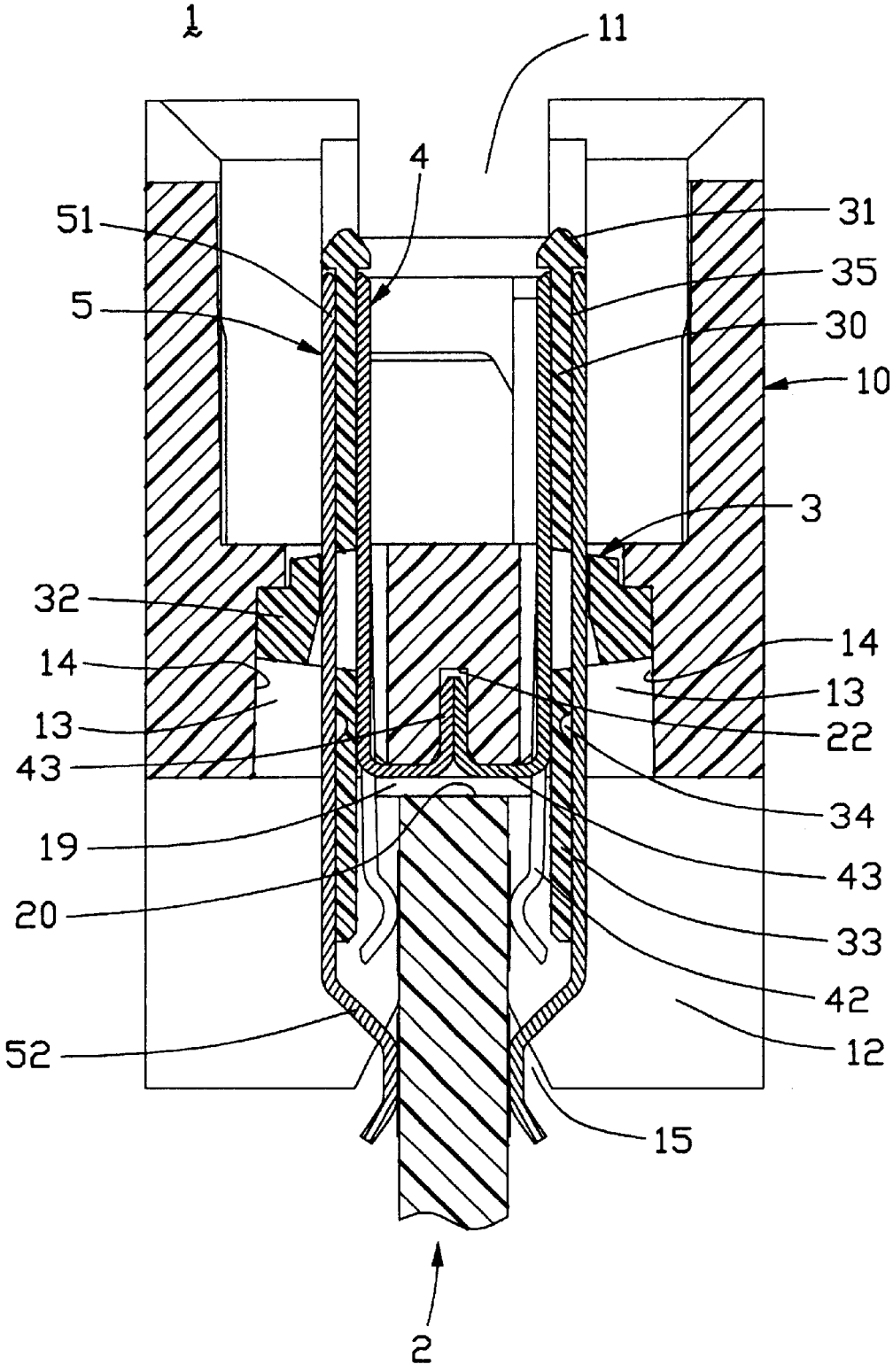
FIG. 3 is a cross-sectional view of the electrical connector taken along line 3—3 in FIG. 1 and showing the electrical connector straddle mounted on a printed circuit board.
Figure 4:
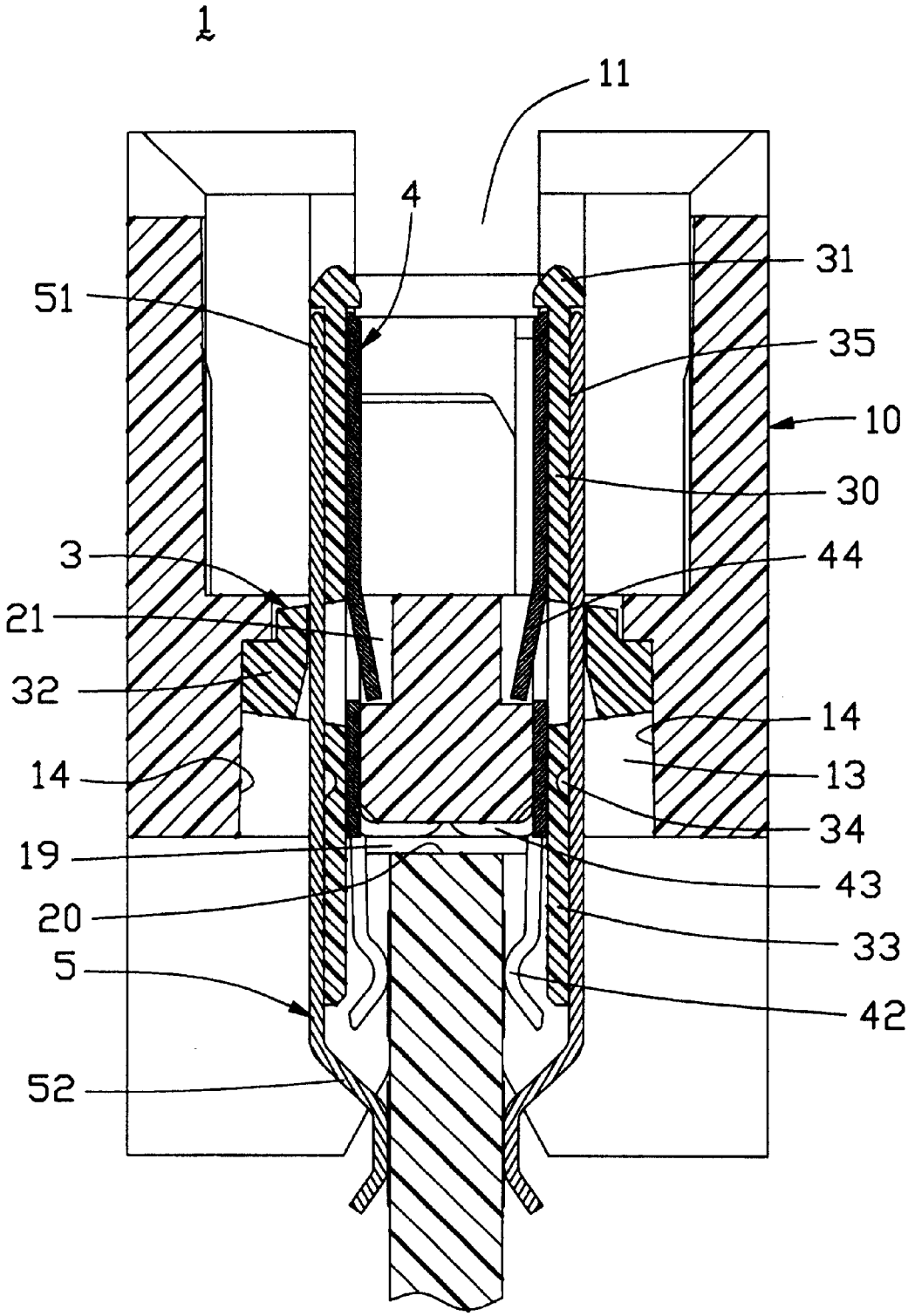
FIG. 4 is a cross-sectional view of the electrical connector taken along line 4—4 in FIG. 1 and showing the electrical connector straddle mounted on a printed circuit board.
Figure 5:
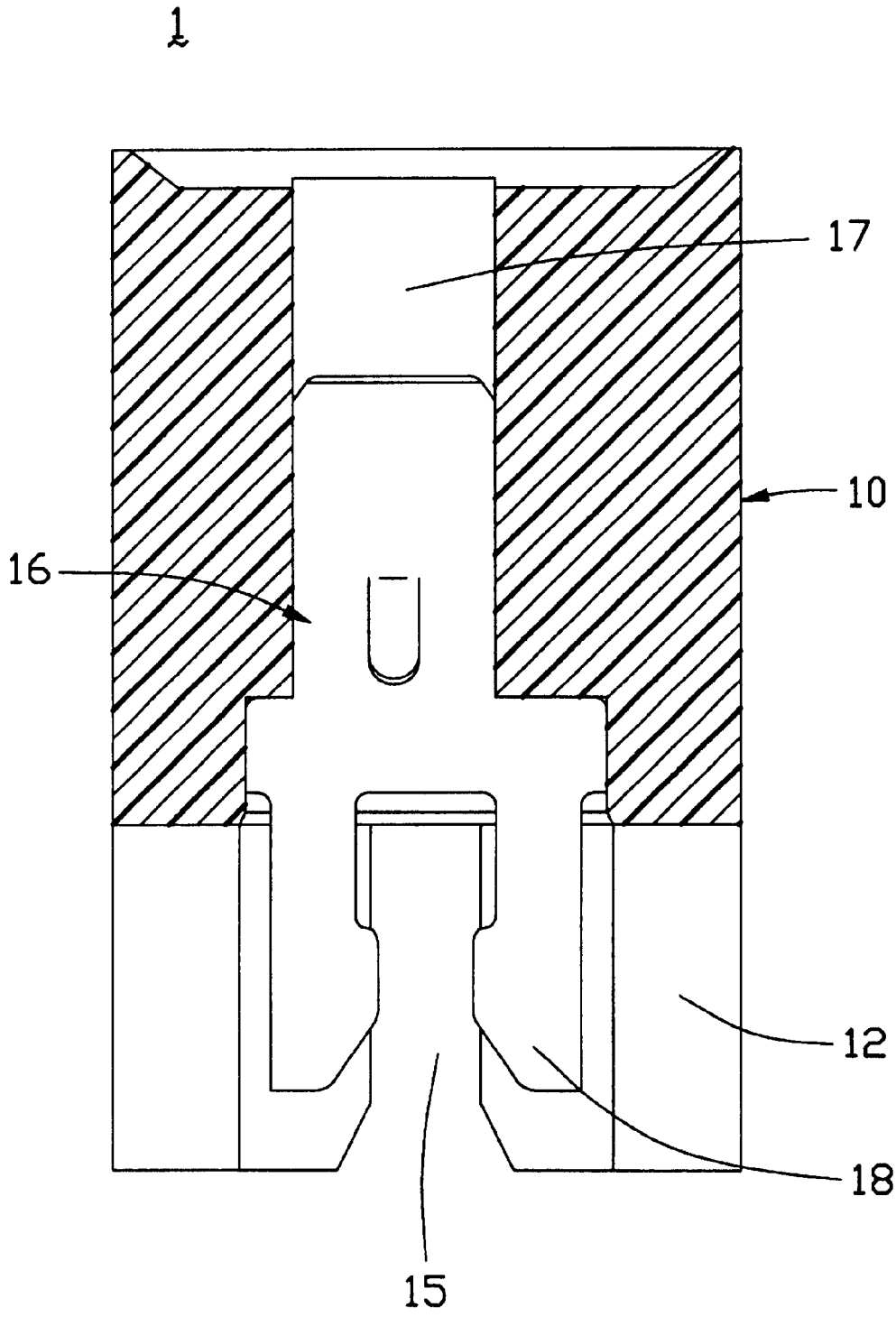
FIG. 5 is a cross-sectional view of the electrical connector taken along line 5—5 in FIG. 1 and showing an anchoring member used to fix the electrical connector onto the printed circuit board.
Figure 6:
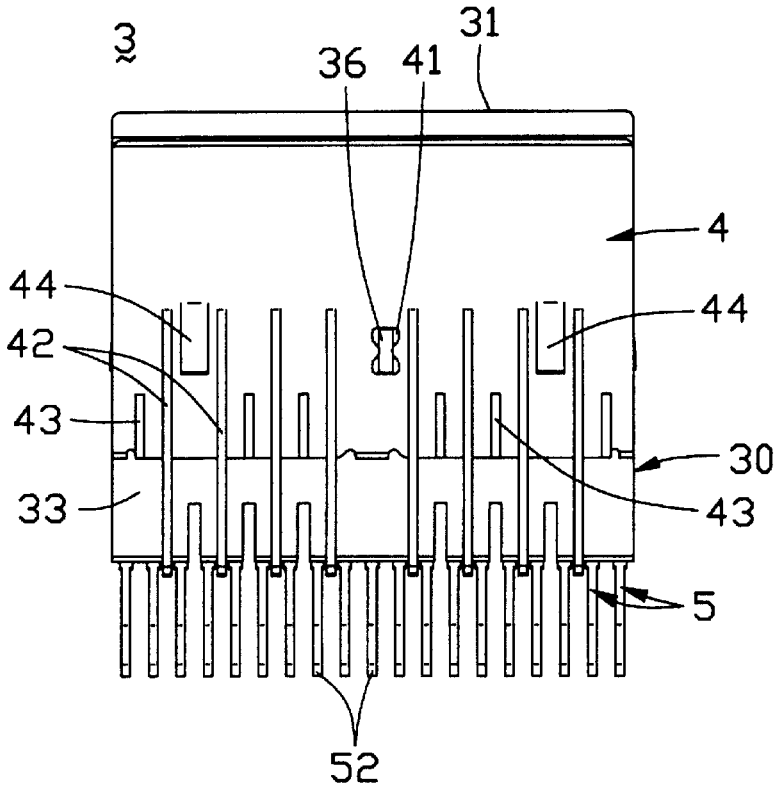
FIG. 6 is an elevation view of a support subassembly of the electrical connector in accordance with the present invention, showing a grounding member assembled to one side thereof.
Figure 7:
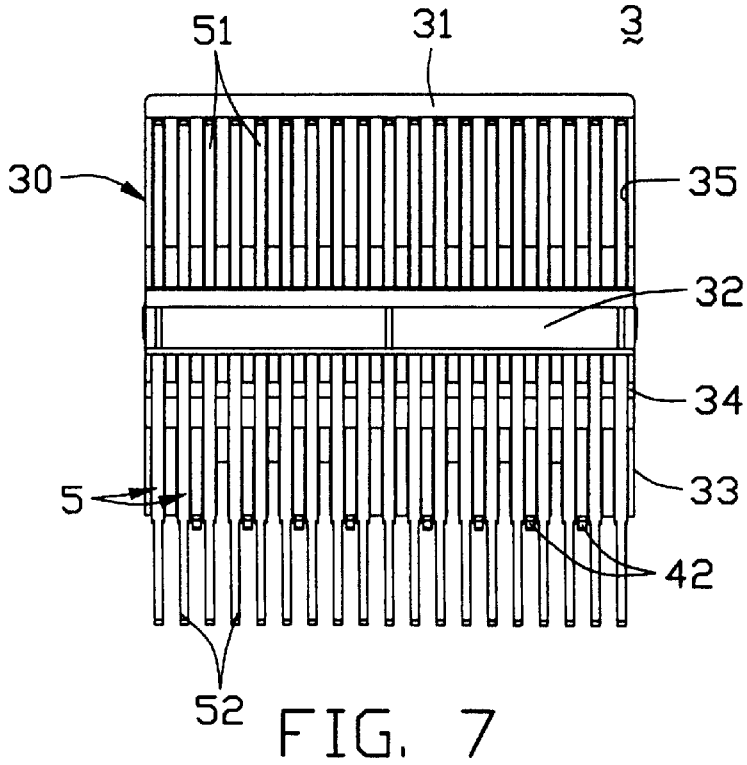
FIG. 7 is an elevation view of the support subassembly of the electrical connector showing an opposite side of the support subassembly where the terminals are assembled.

Referring to FIGS. 1 to 3 and 5, the present invention is related to an electrical connector 1 which is straddle-mounted on an edge 20 of a printed circuit board 2. The connector 1 includes an insulative housing 10 having an elongated mating groove 11 extending along one side face (not labeled) of the housing 10. A number of receiving channels 13 are defined through a mounting side (not labeled) of the housing 10, each of the receiving channels 13 communicating between the mating groove 11 and a mounting side face (not labeled) of the housing 10. An inner sidewall 14 of every receiving channel 13 is sloped from a corresponding mounting side face opening toward the mating groove 11. A central portion (not labeled) of the housing 10 is formed between every pair of opposing receiving channels 13, and a plurality of recesses 21 are defined in outwardly-facing surfaces (not labeled) of the central portion. A plurality of apertures 22 are defined in a mounting side face of the central portion of the housing 10, away from the groove 11 and arranged in a line along a longitudinal axis of the housing 10. A pair of mounting portions 12 are respectively formed at two distal ends of the housing 10, each perpendicularly extending a predetermined distance from the mounting side face. Each mounting portion 12 has a slot 15 formed parallel to the groove 11 for receiving the edge 20 of the printed circuit board 2. A pair of standoffs 19 protrude from the mounting side face of the housing 10, one next to each mounting portion 12 to limit insertion of the edge 20 of the printed circuit board 2 into the slot 15. A pair of anchoring members 16 are received in corresponding slits 17 defined in respective distal ends of the housing 10. Each anchoring member 16 has a fork-shaped tail 18 extending outside the slit 17 and protruding slightly into the corresponding slot 15. The fork-shaped tail 18 of the anchoring member 16 can elastically deform and engage with the printed circuit board 2 when the edge 20 is inserted into the slot 15.

Referring to FIGS. 3 to 4 and 6 to 7, a molded support subassembly 3 with at least two kinds of conductors, grounding and signal, is inserted into and fixed in each receiving channel 13 from the mounting side face of the housing 10. Each support subassembly 3 includes a plane-like base 30 having a lead-in edge portion 31 formed on one side of the base 30 and a separating portion 33 formed on the other side. A bar portion 32 transversely protruding from a middle part of a first surface and along the lengthwise direction of the base 30. An elongated notch 34 is defined in the separating portion 33 near to and parallel to the bar portion 32 to create a hinged area to facilitate and ease bending during final positioning of the separating portion 33. A plurality of parallel passageways 35 is formed on the first surface of the base 30, adjacent the bar portion 32. Each of the passageways 35 passes through and underneath the bar portion 32. A protrusion 36 (see FIG. 6) is formed on an opposite, second surface of the base 30 and extends opposite the bar portion 32. Pin-like signal terminals 5, one kind of conductors, are inserted into the passageways 35 of the base 30 from the separating portion 33 side to the lead-in edge portion 31 side. These terminals 5 can be firmly fixed in the corresponding passageways 35 by barbs formed thereon. Each signal terminal 5 comprises an engaging end 51 accommodated in the corresponding passageway 35 and exposed to the mating groove 11, and a tail end 52 extending out of the receiving channel 13. A plate-like grounding member 4 is attached against the second surface of the support subassembly 3 where the protrusion 36 is located. A hole 41 is formed near the center of the grounding member 4 corresponding to the protrusion 36 of the base 30 to firmly fix the grounding member 4 onto the base 30 by clasping the protrusion 36 inside the hole 41. A plurality;of contacting legs 42 are formed as part of the grounding member 4, each having a distal end extending parallel to each other. The grounding member 4 also comprises a plurality of holding portions 43 formed in a hook shape and neighboring the contacting legs 42. Each holding portion 43 protrudes perpendicularly away from the second surface of the base 30 and has a distal end thereof extending parallel to the surface. Two tabs 44 are stamped at predetermined positions in the middle portion of the grounding member 4.

Figure 8:
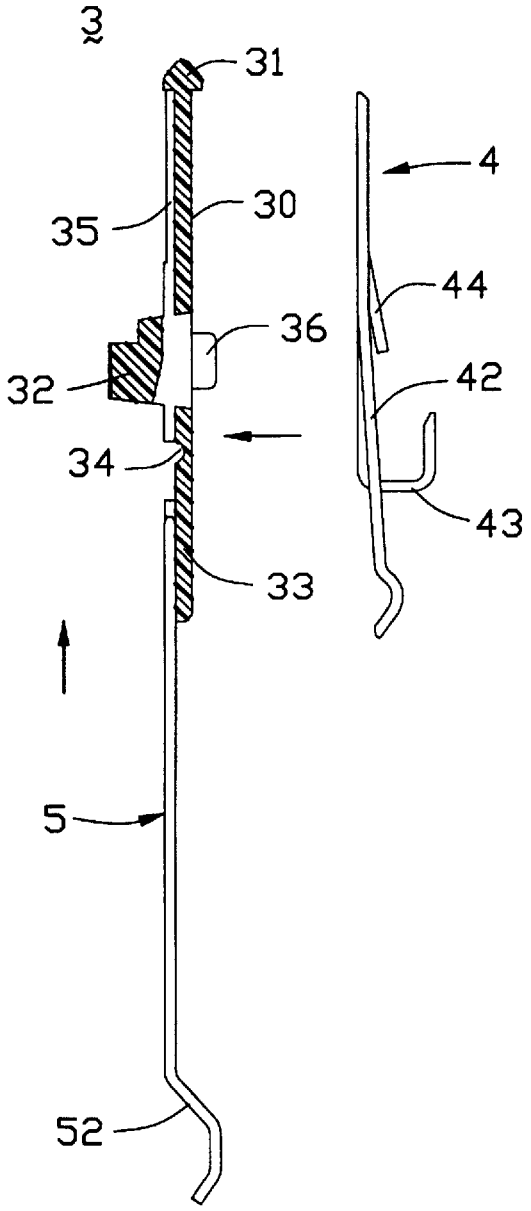
FIG. 8 is a schematic cross-sectional view of the support subassembly of the electrical connector in accordance with the present invention showing the assembling method of the terminals and the grounding member to a base.
Figure 9:
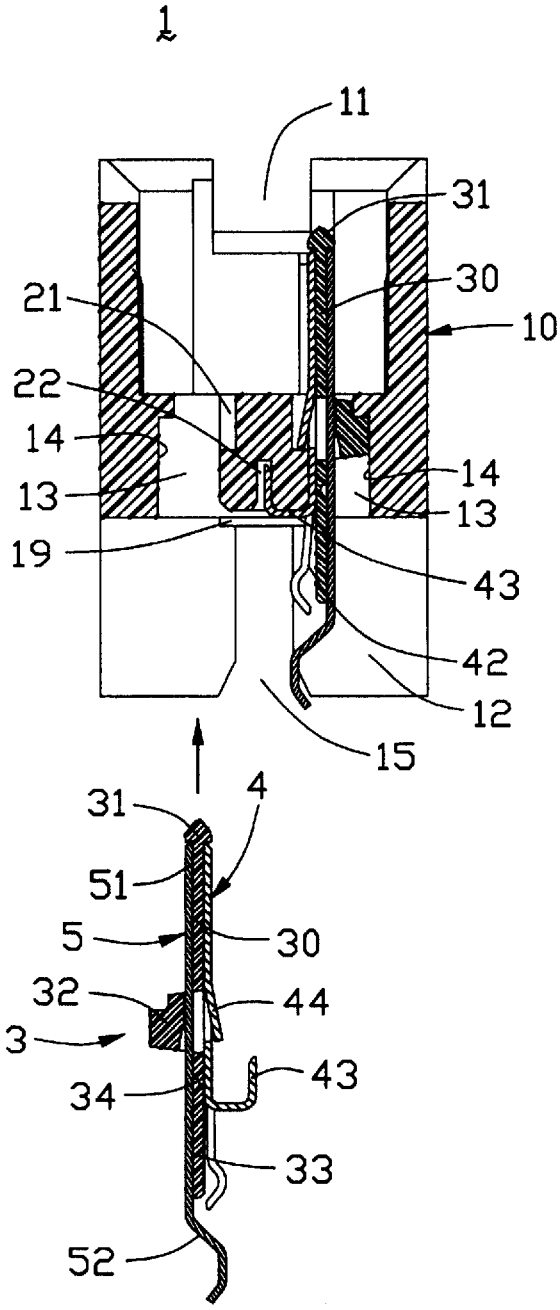
FIG. 9 is a schematic cross-sectional view of the electrical connector in accordance with the present invention showing the assembling method of the support subassembly to the housing.

Referring to FIGS. 8 and 9, in assembly, the signal terminals 5 are inserted into their corresponding passageways 35 respectively along the first surface of the base 30 and each is held in the middle portion by the bar portion 32. The grounding member 4 is then attached on the second surface of the base 30 by fixing the protrusion 36 of the base 30 in the central hole 41 to form a complete support subassembly 3. Every portion of the grounding member 4 is electrically insulated from the terminals 5 on the base 30, including the suspended contacting legs 42, which are isolated from the neighboring tail ends 52 of terminals 5 by the separating portion 33 of the base 30. Every support subassembly 3 is then inserted through the mounting face and into the housing 10, into a corresponding receiving channel 13. Every two support subassemblies 3 are received in two adjacent receiving channels 13 of different rows and are arranged so that the tail ends 52 of the signal terminals 5 and the contacting legs 42 of the grounding members 4 face toward each other and form a space therebetween for holding the printed circuit board 2 therebetween. Additionally, at the very beginning of insertion of each support subassembly 3, the bar portion 32 of the support subassembly 3 is engaged against the corresponding inner sidewall 14 of the corresponding receiving channel 13 while the tabs 44 of the grounding member 4 are engaged with and slide along the surface of the central portion of the housing 10 opposite to the inner sidewall 14. Due to the sloped surface of the sidewall 14, the support subassembly 3 is pushed toward the central portion and the tabs 44 are pressed inwardly, toward the base 30, until the bar portion 32 is stopped at the end of the sidewall 14 and the tabs 44 reach the corresponding recesses 21 (see FIG. 4) of the central portion of the housing 10. Simultaneously, the holding portions 43 of the grounding member 4 are inserted into the corresponding aperture 22 defined in the mounting side face of the central portion of the housing 10. The plate portion of the grounding member 4 and the engaging ends 51 of the terminals 5 are inserted along with the support subassembly 3 into the mating groove 11 and are exposed therein as parts of the mating interface. At the same time, the contacting legs 42 of the grounding member 4 and the tail ends 52 of the terminals 5 all extend outside the housing 10 with their free ends being arranged in two rows parallel to the longitudinal axis of the housing 10, respectively. It is understood that the free ends of terminals 5 and the contacting legs 42 will respectively engage with two corresponding, separate rows of contacting pads formed near the edge 20 of the printed circuit board 2. The separating portions 33 will electrically isolate the free contacting legs 42 and the tail ends 52 from each other to protect them from shoring against each other.

Figure 10:
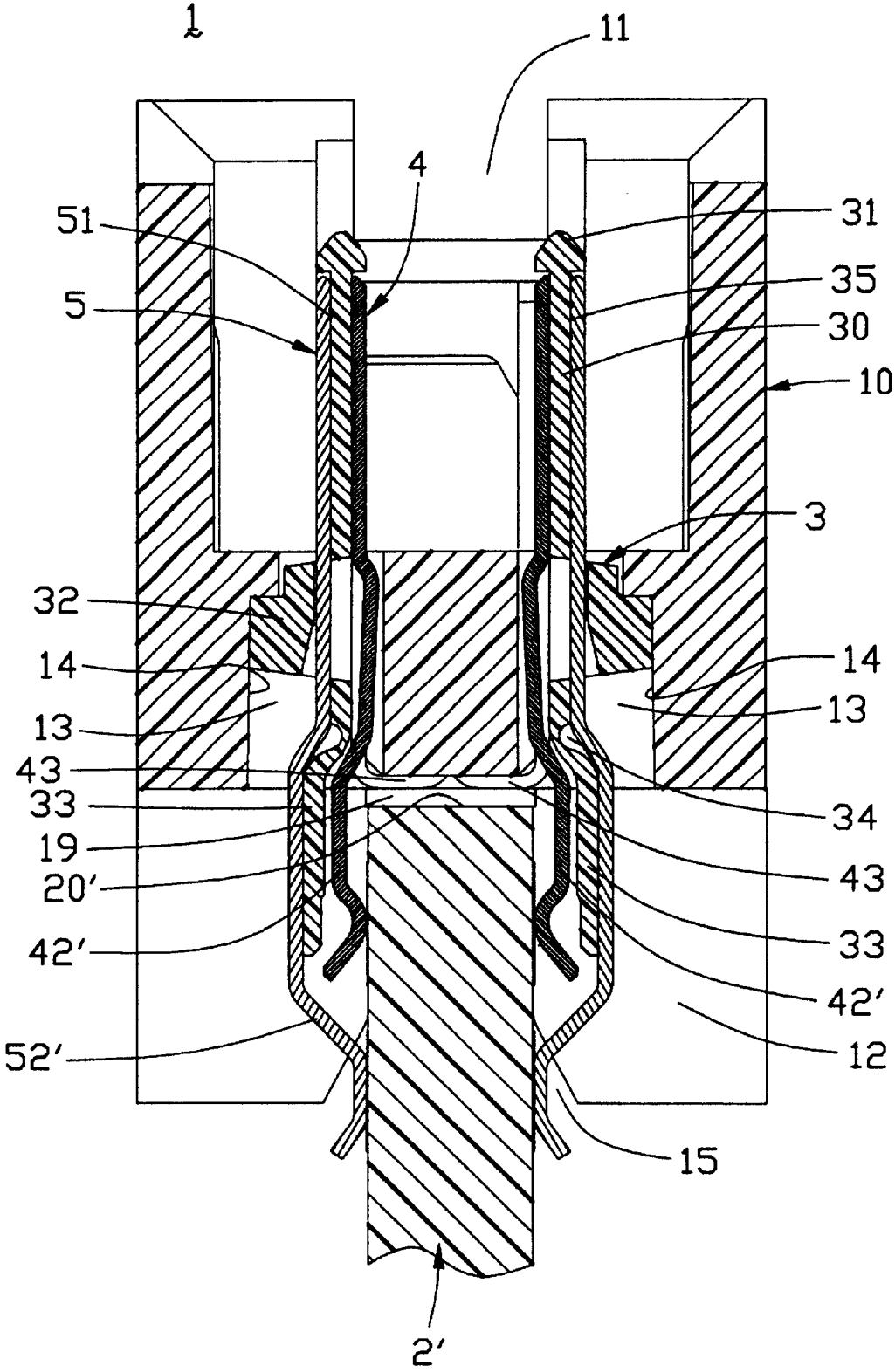
FIG. 10 is a cross-sectional view of the electrical connector in accordance with the present invention showing the electrical connector straddle mounted on a printed circuit board which is thicker than the printed circuit board shown in FIG. 3.

Referring to FIG. 10, a second embodiment of the electrical connector 1' in accordance with the present invention is designed to be straddle-mounted on an edge 20' of a printed circuit board 2' having a larger board thickness. To accommodate the thicker printed circuit board 2', a shape of the tail ends 52' of the terminals 5' and the contacting legs 42' of the grounding members 4' is changed to provide a greater distance between each two of opposite tail ends 52' or contacting legs 42' in both mounted and unmounted positions, when mounted to the thicker, printed circuit board 2'. The distance between opposing tail ends 52' and opposing contacting legs 42' is increased, while the other dimensions of the support subassembly 3' and the housing 10 remain the same. Therefore, the separating portion 33', which maintains electrical separation between one tail end 52'of the terminal 5' and adjoining contacting leg 42' of the grounding member 4', is moved away from the separating portion 33' of the opposite support subassembly 3', by action of the tail end 52' and the contacting leg 42'. Thus, each separating portion 33' is offset from the corresponding base 30' by bending of the thinned hinge area at the elongated notch 34'. Obviously, it is not necessary to replace the whole support subassembly 3' when different printed circuit boards having different thickness are required to be engaged because the distance between each opposing pair of separating portions 33' adjusts to accommodate the bend of the terminals 5' and the contacting legs 42' because of resiliency allowed by the elongate notch 34'.

Figure 11:
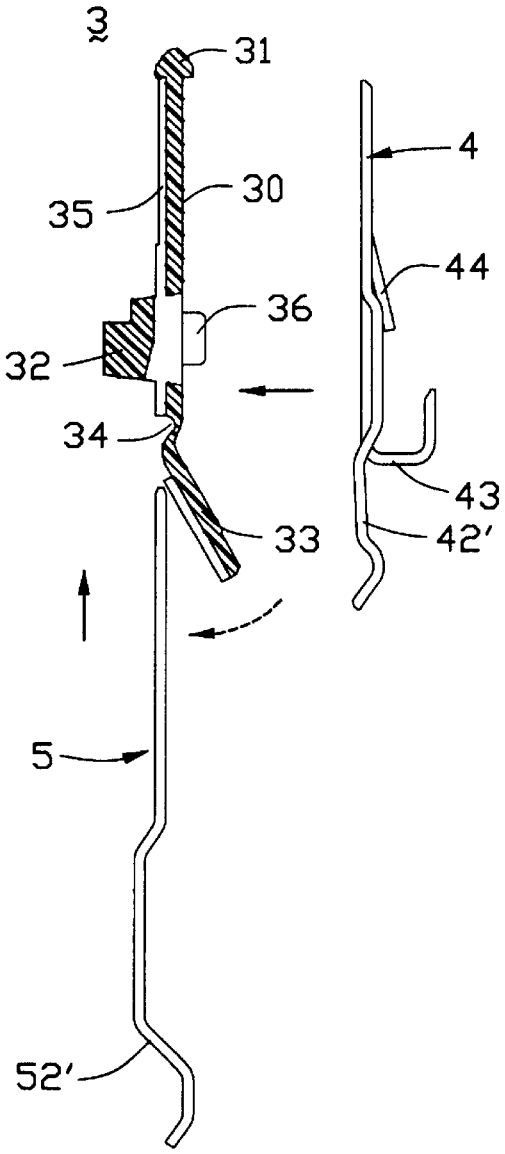
FIG. 11 is a schematic cross-sectional view of the support subassembly of the electrical connector used for straddle mounting on the thicker printed circuit board shown in FIG. 10, and showing the assembling method of the terminals and the grounding member to the base.
Figure 12:
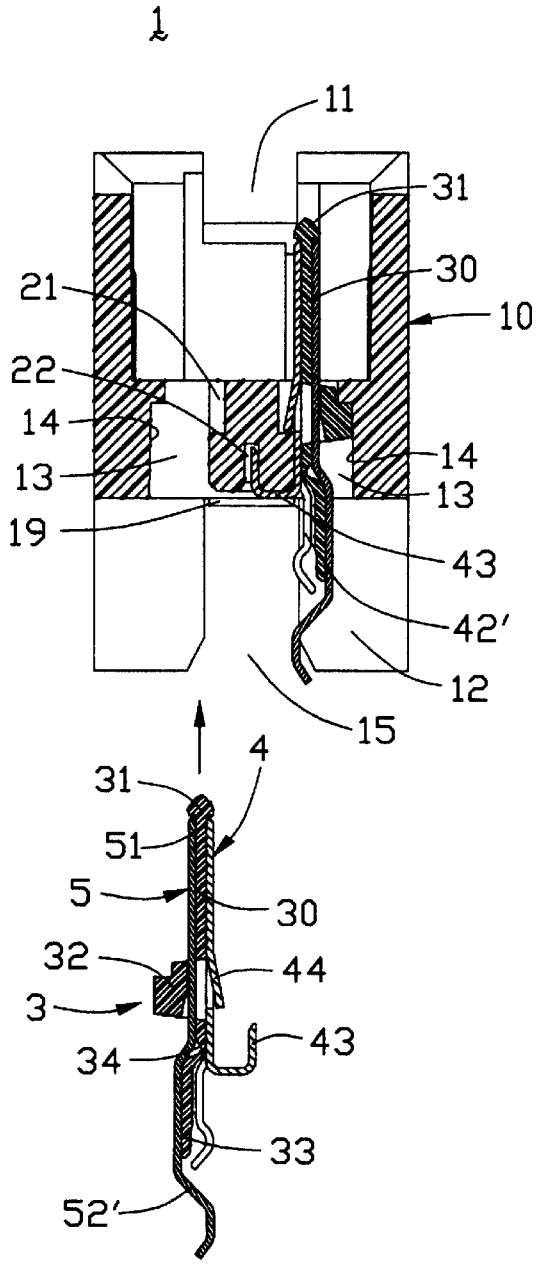
FIG. 12 is a schematic cross-sectional view of the electrical connector used for straddle mounting on the thicker printed circuit board shown in FIG. 10 and showing the assembling method of the support subassembly to the housing.

Referring to FIGS. 11 and 12, in this second embodiment, the assembly process of the support subassembly 3' is changed because the separating portion 33' blocks the direct insertion of the signal terminal 5' into the corresponding passageway 35'. The hinge area at the elongate notch 34' must first be bent outwardly to move the separating portion 33' and then the signal terminals 5' are inserted into their corresponding passageways 35'. The separating portion 33' then moves back to its original, desired position and the grounding member 4' is then attached to the second surface of the base 30' to form a complete support subassembly 3'. The separating portion 33' remains between the tail end 52' of the terminals 5' and the contacting leg 42' of the grounding member 4' and continues to function as an isolator therebetween.

Every support subassembly 3' is inserted into the housing 10 through the mounting side face and into the corresponding receiving channel 13 to finish the assembling process of the connector 1'.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector straddle mounted on a printed circuit board comprising:

a housing having a mating groove for receiving a portion of a mating connector;

a support subassembly having a plurality of conductors being inserted into the housing and extending into the mating groove, each conductor comprising a mating portion exposed in the mating groove and a tail portion for electrically engaging with the printed circuit board; wherein the support subassembly comprises a hinge portion formed thereon and defining the support subassembly as two portions, and one portion of the support subassembly can move around the hinge portion relative to the other portion for being straddle mounted on the printed circuit board having different thickness.

2. The electrical connector as recited in claim 1, wherein said the other portion of the support subassembly is a plastic base and said hinge portion is a thinned area having a notch defined therein.

3. The electrical connector as recited in claim 1, wherein the conductors comprise two kinds of conductors and wherein said one portion of the support subassembly is a separating portion formed as an electrically insulated partition insulating the tail portions of the two kinds of conductors.

4. The electrical connector as recited in claim 3, wherein said the other portion of the support subassembly is a plastic plane base defining a plurality of parallel arranged passageways on one surface of the base, one kind of conductors being received in the passageways on the one surface of the plastic plane base.

5. The electrical connector as recited in claim 4, wherein another kind of conductors is placed on the other surface of the base, the tail portions of which extend along one side of the separating portion.

6. The electrical connector as recited in claim 4, wherein the base comprises a bar portion transversely protruding from said one surface thereof and wherein the housing comprises a slantwise inner sidewall engaged with the bar portion of the base.

7. The electrical connector as recited in claim 1, wherein the conductors comprise pin-like signal terminals.

8. The electrical connector as recited in claim 7, wherein the conductors comprise plane grounding members, each plane grounding member having a mating portion exposed in the mating groove and a plurality of contacting legs for electrically engaging with the printed circuit board.

9. The electrical connector as recited in claim 8, wherein said grounding member comprises a plurality of holding portions formed in a hook shape on one edge thereof neighboring the contacting legs.

10. The electrical connector as recited in claim 9, wherein the housing defines a plurality of apertures for insertion of the holding portions of the grounding member.

11. The electrical connector as recited in claim 8, wherein said grounding member comprises two tabs stamped out of a middle portion of the grounding member and extending laterally for a predetermined length.

12. The electrical connector as recited in claim 11, wherein the housing defines recesses to receive the tabs for securing the support subassembly in the housing.

13. The electrical connector as recited in claim 1, wherein the housing comprises an anchoring member received at two distal ends thereof for engaging with the printed circuit board.

14. An electrical connector straddle mounted on a printed circuit board comprising:

a housing having a mating side face for mating with a mating connector and a mounting side face opposing to the mating side face for abutting against the printed circuit board;

a support subassembly received in the housing and comprising at least two kinds of conductors carrying two different signals and an insulated base installing the conductors, each conductor comprising one end exposed to the mating side face for electrically connecting to the mating connector and another end extending from the mounting side face in a suspended status for electrically engaging with the printed circuit board; wherein said base comprises a separating portion extending a predetermined length therefrom and staying between said suspended ends of said two kinds of conductors to protect said two kinds of conductors from undesired circuit shorting; wherein the base comprises a hinge portion formed thereon, the hinge portion being adjacent to the separating portion to facilitate movement of the separating portion.

15. The electrical connector as recited in claim 14, wherein one kind of said conductors is signal terminals and wherein the base defines a plurality of passageways on one surface thereof, the signal terminals being insertably received in the passageways of said base.

16. The electrical connector as recited in claim 14, wherein one kind of said conductors is a plane-like grounding member installed and abutting against one surface of said base.

17. An electrical connector assembly comprising:

an insulative housing defining an elongated mating groove and a receiving channel communicating with each other; and a support subassembly including a plane-like base with a plurality of juxtaposed signal terminals on one surface thereof and a grounding member on the other surface thereof, said support subassembly extending through said receiving channel and into the mating groove; wherein said grounding member includes retention means to latchably engage the housing for retaining said subassembly to said housing.

18. An electrical connector assembly comprising:

an insulative housing defining an elongated mating groove and a receiving channel communicating with each other; and a support subassembly including a plane-like base with a plurality of juxtaposed signal terminals on one surface thereof and a grounding member on the other surface thereof, said support subassembly extending through said receiving channel and into the mating groove;

said signal terminals including tails, said grounding member including contacting legs, both of said tails and said legs extending rearwardly around a rear portion of the housing, said base including a separating portion isolating said tails and said legs from each other; wherein the separating portion with the tails and the contacting legs thereon is pivotal relative to the housing for compliance with different thickness printed circuit boards engaged therewith.

* * * * *